United States Patent [19]

Henderson et al.

[11] 4,221,023

[45] Sep. 9, 1980

[54] CARDING FLAT STRUCTURE

[75] Inventors: William E. Henderson, Simpsonville; Jerry B. Goering, Mauldin; Gene A. Dempsey, Lyman, all of S.C.

[73] Assignee: John D. Hollingsworth on Wheels, Inc., Greenville, S.C.

[21] Appl. No.: 940,002

[22] Filed: Sep. 6, 1978

[51] Int. Cl.[2] ..... D01G 15/24

[52] U.S. Cl. ..... 19/113

[58] Field of Search ..... 19/112–114, 19/102

[56] References Cited

U.S. PATENT DOCUMENTS

| | | | |
|---|---|---|---|
| 3,737,953 | 6/1973 | Bechtel, Jr. | 19/113 |
| 3,793,677 | 2/1974 | Bechtel, Jr. | 19/113 |
| 3,936,911 | 2/1976 | Roberts | 19/113 |
| 4,074,392 | 2/1978 | Bechtel, Jr. | 19/113 |

FOREIGN PATENT DOCUMENTS

| | | | |
|---|---|---|---|
| 1222918 | 1/1960 | France | 19/113 |

*Primary Examiner*—Louis Rimrodt

*Attorney, Agent, or Firm*—Bailey, Dority & Flint

[57] ABSTRACT

A carding flat is illustrated wherein segments of metallic wire are retained upon a base strip by opposed brackets each of which is attached to the base strip and to the wire by an upper leg and an intermediate inwardly projecting element which carries fastening means for interlocking engagement with a lower engaging portion of the base strip, and a lower flange is provided for securing this assembly upon a flat iron or casting.

2 Claims, 2 Drawing Figures

CARDING FLAT STRUCTURE

BACKGROUND OF THE INVENTION

Metallic flat clothing has been utilized in the past such as illustrated in U.S. Pat. Nos. 3,737,953, 3,793,677, 3,936,911 and 4,074,392. The segments of metallic wire are preferably initially secured to an extruded plastic base strip in accordance with a construction illustrated and described in U.S. Pat. No. 3,936,911, the disclosure of which is incorporated herein and made a part hereof by reference.

U.S. Pat. No. 4,074,392 illustrates a clip which is secured by intermediate tabs to the base strip all for the purpose of securing the base strip upon the flat iron. It will be noted that none of the structures illustrated in the aforesaid patents comprise segments of metallic wire which are positively secured to either the extruded base or to the flat casting.

French Pat. No. 1,222,918 published June 14, 1960, shows mounting or setting material above a reduced end of metallic clothing segments with a clip having a pair of spaced legs embracing the setting material, segment ends and flat iron. Such a construction would be impractical, however, as there is no base strip for assembly and retention of the metallic wire segments.

Accordingly, it is an important object of the present invention to provide an assembly wherein segments of metallic wire are secured to a base strip positively with the provision of an assembly formed thereby which may be positively secured to a flat casting for the purpose of providing a unitary construction wherein the segments of metallic wire may not be dislodged and wherein the assembly may be formed with positive securement for the segments of metallic wire with the brackets positively secured thereto for positive positioning upon the flat casting.

Another important object of the invention is to provide a structure for positively attaching segments of metallic wire for carding flats wherein the method of assembly is facilitated through the provision of flat strips which may be, in turn, secured by positively fastened brackets to the flat castings. Such a construction facilitates replacement of worn strips with preassembled strips which may be kept in regular inventory for this purpose.

Another important object of the present invention is the provision of improved flat constructions wherein the possible damage to the card clothing of the other carding elements aside from the flats, is minimized by positive securement of the card clothing to the flats.

BRIEF DESCRIPTION OF THE INVENTION

It has been found that a carding flat construction may be provided wherein segments of metallic wire clothing may be positively positioned by means of a clip having an upper leg for overlying end portions of the segment and together with an inwardly projecting intermediate element carrying fastening means interlocking with a lower engaging portion of a base strip from a flat strip assembly which may, in turn, be mounted for positive retention of the segments as well as the assembly upon the flange of the flat casting. A bevel upon a leading edge of the clothing of the carding flat facilitates the operation of the flat construction since the beveled surface is inclined away from the direction of travel to facilitate passage of the flat over any member or surface with which it should inadvertently become engaged.

This, together with positive positioning of the segments of metallic wire card clothing, insures that such will remain firmly positioned upon the flats without the possibility of dislodgement, thereby damaging the card clothing or the various carding elements of the carding apparatus.

BRIEF DESCRIPTION OF THE DRAWING

The construction designed to carry out the invention will be hereinafter described, together with other features thereof.

The invention will be more readily understood from a reading of the followng specification and by reference to the accompanying drawing forming a part thereof, wherein an example of the invention is shown and wherein.

DESCRIPTION OF A PREFERRED EMBODIMENT

Figure 1:
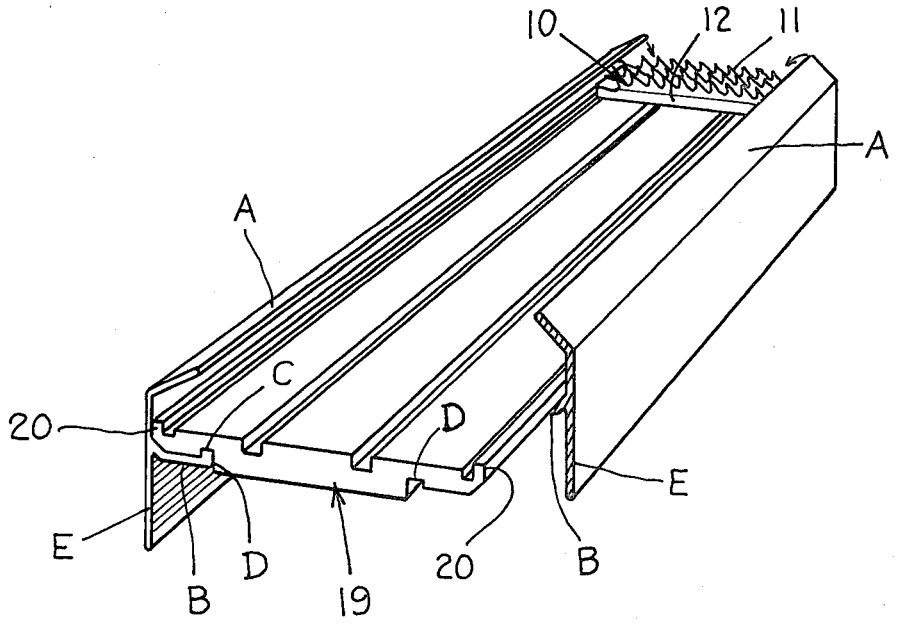
FIG. 1 is a perspective view illustrating the carding flat strip construction hereof wherein an assembly is formed positively positioning the transverse segments of metallic wire clothing and affixing the bracket for so retaining the segments preparatory to mounting same upon a flat casting.

The drawing illustrates a carding flat clothed with transverse segments of metallic wire having teeth therein carried upon a plastic base strip for positioning upon the flange of a flat casting. A pair of opposed elongated longitudinal brackets are marginally carried by the base strip. Each of the brackets have a substantially horizontal upper leg A overlying and retaining aligned end portions of the segments of metallic wire. An inwardly projecting element B has fastening means C carried thereby. The base strip has a lower engaging portion D for securement with the fastening means. A lower flange E extends inwardly beneath the flange of the flat casting. Thus, the bracket positively secures the segments of metallic wire upon the base strip and the bracket to the base strip forming a flat assembly which is secured to the flat casting.

Figure 2:
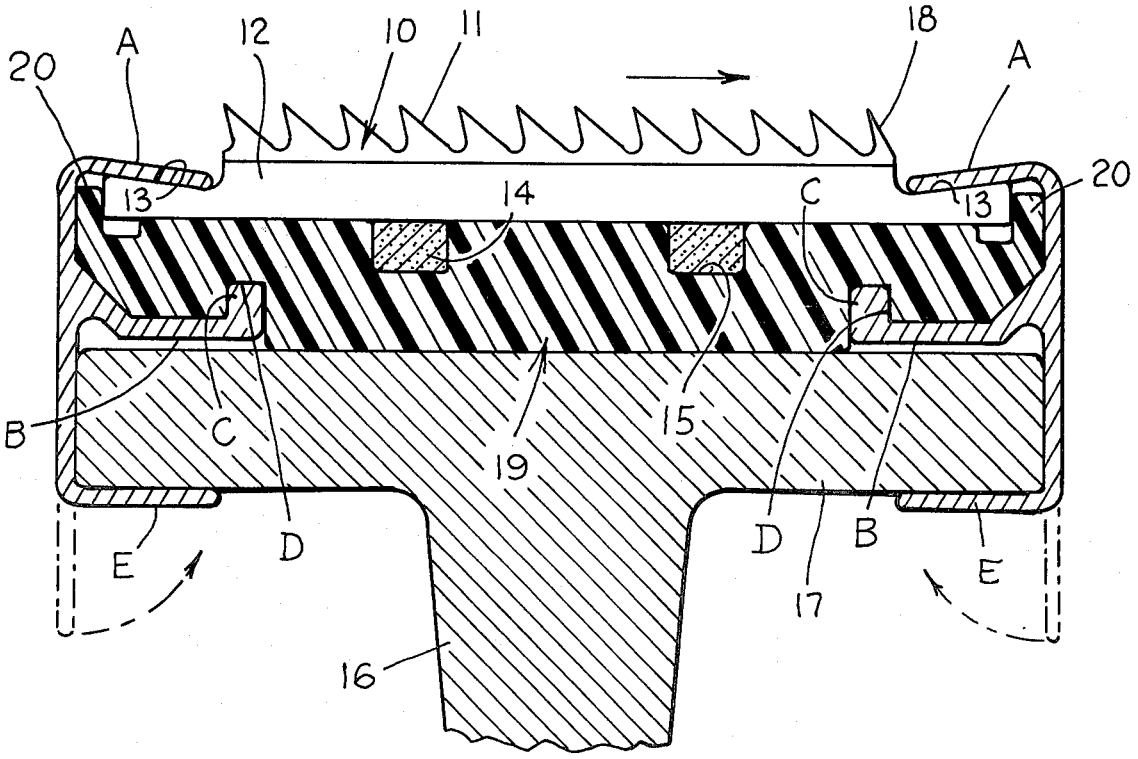
FIG. 2 is an enlarged transverse sectional elevation of the carding flat strip illustrated in FIG. 1 further illustrating the construction of the bracket and assembly for positioning the carding strip upon the flat casting.

The drawing illustrates a carding flat having transverse segments of metallic wire broadly designated at 10 having teeth 11 carried therein. Each of the segments 10 has an enlarged shoulder 12 of the usual construction and a flat portion 13 is carried at each end of the aligned segments. The cutout or flat portions 13, as illustrated in FIG. 2, preferably taper from the inner portion thereof outwardly upwardly for facilitating the securement of the bracket with respect thereto. The segments 10 are illustrated as being secured as by adhesive 14 which may be received within the longitudinal slots 15 in the fashion described in said U.S. Pat. No. 3,936,911. It will be noted that the flat moves in the direction of the arrow in FIG. 2 being carried upon a flat iron or casting 16 having a flange 17 upon which the base strip assembly hereof is mounted. The metallic segments on the leading edge thereof are beveled, as illustrated at 18 in FIG. 2 and the bevel 18 is formed by aligned strips having complementary beveled surfaces thereon forming the continuous bevel 18.

The plastic base strip hereof is an extrusion and is broadly designated at 19. The strip has elongated longitudinal grooves 15 therein for receiving adhesive for initially positioning the segments of the metallic clothing 10 thereon. The base strip 19 also has upwardly extending marginal portions 20 carried thereon facilitating reception of the segments therebetween. The brackets are illustrated as including a substantially horizontal upper leg A which is bent to incline downwardly in complementary fashion to conform to the flat end surfaces 13 of the wire segments for retention of the bracket complementary to the inwardly projecting element B which has fastening means C carried thereby. The base strip 19 has a lower engaging portion for securement with the fastening means in interlocking engagement therewith. The lower flange E, as a final step in the assembly process, is clamped inwardly to pass beneath the flange 17 of the flat casting for securing the flat strip assembly in position for forming the carding flat.

It is thus seen that a carding flat is provided wherein all of the elements are secured in interlocking engagement positively positioning them to avoid dislodgement during carding with consequent damage to the equipment with machine down time. The assembly of carding flats is facilitated by making possible the assembly of strip constructions with teeth and bracket means positively secured thereto for positive attachment of all the elements upon a flat iron. The flat constructions hereof are useful in carding over an extended period with minimum maintenance and minimum possibility of damage to associated equipment.

While a preferred embodiment of the invention has been described using specific terms, such description is for illustrative purposes only, and it is to be understood that changes and variations may be made without departing from the spirit or scope of the following claims.

What is claimed is:

1. A carding flat clothed with transverse segments of metallic wire having teeth therein carried upon a plastic base strip for positioning upon a flange of a flat casting comprising:

a pair of opposed elongated longitudinal brackets marginally carried by said base strip, each of said brackets having;

a substantially horizontal upper leg overlying and retaining aligned end portions of said segments of metallic wire;

an inwardly projecting element having fastening means carried thereby;

said base strip having a lower engaging portion for securement with said fastening means; and a lower flange extending inwardly beneath said flange of said flat casting;

whereby said bracket positively secures the segments of metallic wire upon said base strip and the bracket to said base strip forming a flat assembly which is secured to said flat casting.

2. The structure set forth in claim 1 wherein said (inwardly projecting element has) fastening means have (for) interlocking engagement with said lower engaging portion.

* * * * *